US008659233B2

(12) United States Patent
Nerone et al.

(10) Patent No.: US 8,659,233 B2
(45) Date of Patent: Feb. 25, 2014

(54) FLUORESCENT LAMP BALLAST WITH ELECTRONIC PREHEAT CIRCUIT

(75) Inventors: Louis Robert Nerone, Brecksville, OH (US); Gordon Alexander Grigor, Cleveland Heights, OH (US)

(73) Assignee: General Electric Company, Schenectady, NY (US)

( * ) Notice: Subject to any disclaimer, the term of this patent is extended or adjusted under 35 U.S.C. 154(b) by 257 days.

(21) Appl. No.: 12/604,486

(22) Filed: Oct. 23, 2009

(65) Prior Publication Data

US 2011/0095693 A1 Apr. 28, 2011

(51) Int. Cl.
*G05F 1/00* (2006.01)

(52) U.S. Cl.
USPC ..... 315/244; 315/307; 315/308; 315/291

(58) Field of Classification Search
USPC ..... 315/105, 291, 307, 308, 244
See application file for complete search history.

(56) References Cited

U.S. PATENT DOCUMENTS

| | | | | |
|---|---|---|---|---|
| 5,345,148 | A | 9/1994 | Zeng et al. | |
| 5,406,471 | A | 4/1995 | Yamanaka | |
| 5,920,155 | A * | 7/1999 | Kanda et al. | 315/307 |
| 5,959,410 | A | 9/1999 | Yamauchi et al. | |
| 6,266,256 | B1 | 7/2001 | Lehnert | |
| 6,510,062 | B2 | 1/2003 | Goder et al. | |
| 6,577,077 | B2 * | 6/2003 | Hu et al. | 315/291 |
| 6,653,800 | B2 * | 11/2003 | Chen | 315/244 |
| 6,696,803 | B2 * | 2/2004 | Tao et al. | 315/291 |
| 6,791,848 | B2 | 9/2004 | Porter et al. | |
| 6,961,251 | B2 | 11/2005 | Porter et al. | |
| 7,135,934 | B2 | 11/2006 | Sanchez et al. | |
| 7,271,545 | B2 | 9/2007 | Hu et al. | |
| 7,279,958 | B1 | 10/2007 | Mullin et al. | |
| 7,291,983 | B2 | 11/2007 | Hu et al. | |
| 7,391,630 | B2 | 6/2008 | Acatrinei | |
| 7,449,841 | B2 | 11/2008 | Ball | |
| 2002/0140357 | A1 * | 10/2002 | Randazzo et al. | 315/105 |
| 2003/0085670 | A1 | 5/2003 | Chen | |
| 2005/0052220 | A1 | 3/2005 | Burgener et al. | |
| 2006/0197608 | A1 | 9/2006 | Sanchez et al. | |
| 2007/0159116 | A1 | 7/2007 | Hu et al. | |
| 2007/0247006 | A1 | 10/2007 | Ball | |
| 2008/0191784 | A1 | 8/2008 | Khoury et al. | |
| 2009/0033244 | A1 | 2/2009 | Wang et al. | |

FOREIGN PATENT DOCUMENTS

| | | | |
|---|---|---|---|
| EP | 1991033 | A2 | 11/2008 |
| GB | 2224170 | A | 4/1990 |

OTHER PUBLICATIONS

Fengfeng Tao et al: "Self-oscillating electronic ballast with dimming control", 32nd Annual Power Electronics Specialist Conference. PESC 2001. Vancouver, Canada Jun. 17-21, vol. 4, 17, Jun. 17, 2001, pp. 188-1823 XP 010559203.

WO Search Report issued in connection with corresponding WO Patent Application No. US10/48842 filed on Sep. 15, 2010.

Chinese Applications No. 201080049056A Office Action mailed Nov. 5, 2013.

* cited by examiner

*Primary Examiner* — Douglas W Owens
*Assistant Examiner* — Amy Yang
(74) *Attorney, Agent, or Firm* — Fay Sharpe LLP

(57) ABSTRACT

Fluorescent lamp ballasts and methods are disclosed in which a resonant impedance of a self-oscillating inverter is modified to control the inverter frequency to selectively preheat lamp cathodes using power from the inverter output during a pre-heating period after power is applied and to change the inverter frequency to a different range following ignition of the lamp.

19 Claims, 4 Drawing Sheets

FLUORESCENT LAMP BALLAST WITH ELECTRONIC PREHEAT CIRCUIT

BACKGROUND OF THE DISCLOSURE

This disclosure relates to ballasts for powering fluorescent lamps including compact fluorescent lamps (CFLs). This type of lamp includes cathodes (filaments) which are preferably preheated before ignition to extend the operational life of the lamp. The lamp cathodes are covered with emission mix to facilitate passage of electrons through the gas for production of light. Over time, the emission mix is sputtered off of the cathodes in normal operation, but a larger amount is sputtered off when the lamp is ignited with cold cathodes. When the emission mix becomes depleted, a higher voltage is required for the cathodes to emit electrons, a condition sometimes referred to as end-of-life ("EOL"). The higher voltage results in an increase in temperature which may overheat the lamp and in some cases crack the glass if the lamp is not replaced.

Conventional low cost CFL ballasts often use a positive temperature coefficient (PTC) thermistor to heat the lamp cathodes of the lamp prior to ignition (preheat). The PTC is coupled in parallel with a capacitor connected across the CFL, and initially conducts allowing preheating current to flow through the lamp cathodes. With continued conduction, the PTC device heats up and the PTC resistance increases, eventually triggering ignition of the gas in the lamp. The PTC, moreover, is typically situated in close proximity to the lamp to keep the PTC in the high-impedance condition during normal operation of the lamp. However, PTC devices are costly and occupy valuable space in the ballast. In addition, the PTC element never reaches infinite impedance and thus conducts some amount of current throughout operation of the ballast (even if some of the energy to keep the PTC device warm comes from lamp heating). Thus, the use of PTC devices for cathode preheating negatively impacts ballast efficiency. Furthermore, PTC preheating circuits need time to cool before reapplication of power to avoid cold-cathode ignition and the associated lamp degradation. Thus, a need remains for improved ballasts and techniques for preheating fluorescent lamp cathodes without using PTC components.

SUMMARY OF THE DISCLOSURE

Ballast devices and filament preheating methods are provided in which a resonant impedance of a self-oscillating inverter is selectively adjusted to control the inverter frequency for preheating lamp cathodes via inverter output current during a preheating period after power is applied and to thereafter change the inverter frequency for lamp ignition.

A fluorescent lamp ballast is provided, having a rectifier or other DC power circuit to receive an AC input and to produce a DC output, and a frequency controlled inverter that converts the DC to provide an inverter output for powering one or more fluorescent lamps. The ballast also includes a preheating circuit that selectively modifies an impedance in the frequency control circuit to control the frequency of the inverter output to be in a first range during a preheating period following application of power to the DC power circuit to preheat at least one cathode of the lamp using power from the inverter output. The preheating circuit then controls the frequency of the inverter output to be in a different second range following ignition of the lamp. The ballast in some embodiments may include diodes individually coupled across lamp terminals associated with first and second cathodes of the lamp to block current flow from the inverter output and terminate oscillation of the inverter when the lamp is disconnected from the terminals, but primarily to reduce the power dissipation in the cathodes. Some embodiments of the preheating circuit modify an inverter capacitance to control the inverter output frequency, such as by providing an auxiliary capacitance, a switching device coupled between the auxiliary capacitance and the inverter capacitance, and a timer circuit to actuate the switching device to connect the auxiliary capacitance in parallel with the inverter capacitance a predetermined time following application powerup. In other embodiments, the preheating circuit modifies an inverter inductance to control the frequency of the inverter output, where the preheating circuit includes a switching device coupled across the inverter inductance and a timer circuit that actuates the switching device to shunt the inverter inductance a predetermined time following after power is applied to the DC power circuit.

A fluorescent lamp ballast is also provided, which includes a DC power circuit, an inverter to convert the DC output of the power circuit to produce an inverter output to power at least one fluorescent lamp, a preheating circuit operative to preheat the lamp cathodes, and first and second diodes individually coupled across lamp terminals associated with first and second cathodes of the lamp to block current flow from the inverter output and terminate oscillation of the inverter when the lamp is disconnected from the terminals.

A method is provided for operating one or more fluorescent lamps, including converting an AC input to produce a DC output, converting the DC output using an inverter to produce an inverter output to power at least one fluorescent lamp, and modifying at least one impedance to control an operating frequency of the inverter to be in a first range during a preheating period following application of power to the inverter to preheat at least one cathode of the lamp using power from the inverter output and to control the frequency of the inverter output to be in a different second range following ignition of the lamp. In certain embodiments, modifying the impedance includes selectively connecting an auxiliary capacitance in parallel with at least one capacitance of the inverter a predetermined time following application of power to the inverter. In other embodiments, selectively shunting at least one inductance of the inverter a predetermined time following application of power to the inverter.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
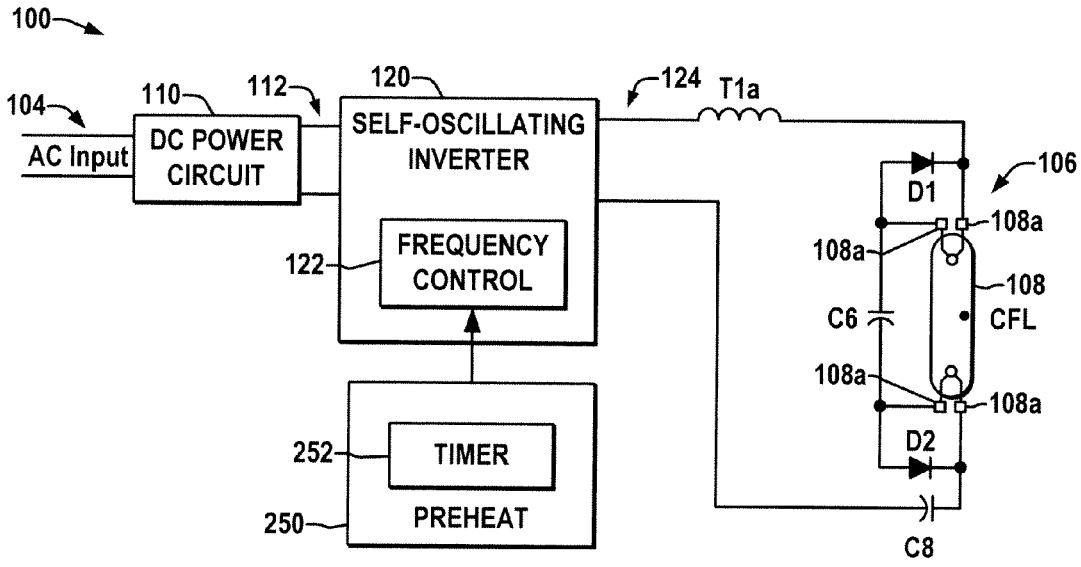
FIG. 1 is a schematic diagram illustrating an exemplary fluorescent lamp ballast with an inverter output frequency controlled by a preheating circuit to provide filament heating via the inverter output during initial startup.

Referring now to the drawings, where like reference numerals are used to refer to like elements throughout, and where the various features are not necessarily drawn to scale, the present disclosure relates to ballasts and methods that may be used in connection with any type of fluorescent lamps and will be described in the context of certain embodiments used with compact fluorescent lamps (CFLs). Moreover, the described embodiments and shown in single-lamp applications, although multiple-lamp configurations are possible.

FIG. 1 shows a ballast 100 with a DC power circuit 110 that converts AC power at an input 104 to provide a DC output 112 to an inverter 120. Any form of DC power circuit 110 may be employed, for example, a full or half-bridge passive rectifier, an active rectifier, or other circuitry that provides a DC output. The inverter 120 may be any switching-type DC-AC converter controlled by pulse width modulation, duty cycle control or other suitable switching control technique having suitable switching devices operated to generate an output 124 suitable for powering one or more fluorescent lamps 108. The example of FIG. 1 is a self-oscillating inverter producing an output 124 to power a CFL 108 coupled to a ballast output 106, and the inverter 120 includes a frequency control circuit 122 operative to control the frequency of the inverter output 124. The inverter 120 drives a resonant circuit including an inductance T1*a* and capacitances C6 and C8, and the CFL load is coupled with the output via terminals 108*a* to which CFL filaments (hereinafter 'cathodes') are connected. The ballast output 106 includes the capacitor C6 coupled between two opposing cathode terminals 108*a* as well as diodes D1 and D2 individually coupled across lamp terminals 108*a* associated with first and second cathodes of the lamp 108. In operation before lamp ignition, the preheating current from the inverter 120 flows through one lamp cathode, the capacitor C6 and then through the other cathode. Once the lamp 108 is ignited, arc current flows in the lamp 108 with the diodes D1 and D2 rectifying the voltage across the cathodes and reducing the power dissipated in the cathodes during steady-state. Moreover, if the lamp 108 is removed during ballast operation, the diodes D1 and D2 block current flow from the inverter output 124 and terminate the inverter oscillation to avoid potential oscillation run-away conditions.

Figure 2:
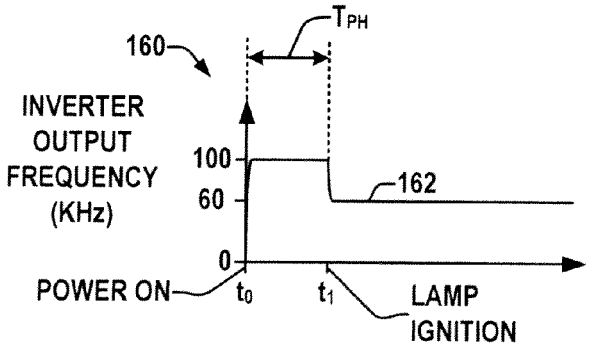
FIG. 2 is a graph illustrating the inverter output frequency controlled by the preheating circuit in the ballast of FIG. 1 for initial cathode preheating.

Referring also to FIG. 2, the ballast 100 of FIG. 1 includes a preheating circuit 250 operatively coupled with the inverter 120 to adapt the inverter frequency control circuit 122 by modification of one or more impedances therein. In this manner, the preheating circuit 250 performs inverter frequency control, which in turn controls the output current level of the inverter 120. In particular, as shown in the graph 160 of FIG. 2, the preheating circuit 250 operates to control the inverter frequency 162 in a first range (e.g., about 100 KHz in one example) during a preheating period $T_{PH}$ following application of power to the DC power circuit 110 (at $t_0$ in FIG. 2) to preheat the lamp cathode(s) using power from the inverter output 124. In specific embodiments outlined below, the preheat time $T_{pH}$ from $t_0$ to $t_1$ is set by a timing circuit 252 in the preheating circuit 250. Once the preheating period expires ($t_1$ in FIG. 2), the preheating circuit 250 lowers the frequency 162 of the inverter output 124 to a second range (e.g., 60 KHz in one example) to initiate lamp ignition and thereafter to control the lamp current to the desired level in normal operation.

Figure 3:
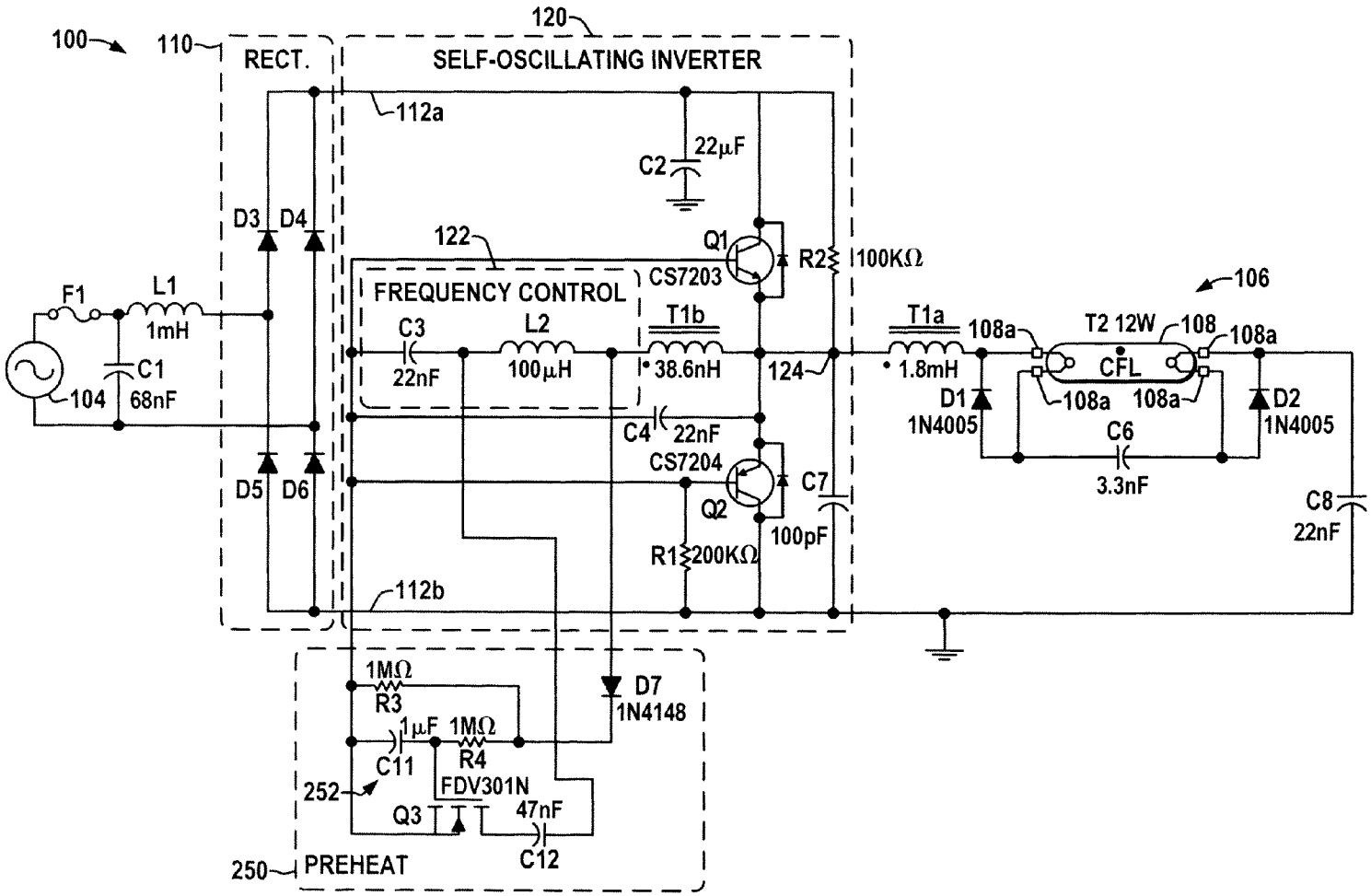
FIG. 3 is a schematic diagram illustrating a fluorescent lamp ballast embodiment with a preheat circuit operative to modify a capacitance of the inverter for preheating the lamp cathodes.

FIG. 3 shows a detailed embodiment of a fluorescent lamp ballast 100 with a preheating circuit 250 operative to modify a resonant capacitance C3 of the inverter for preheating the lamp cathodes via inverter output frequency control. An AC source 104 provides input power via a fuse F1 to an input filter stage including inductor L1 and capacitor C1 to a full wave bridge rectifier DC power circuit 110 comprised of diodes D3-D6 to provide a DC output to a self-oscillating inverter 120. The inverter 120 in FIG. 3 includes upper and lower switching devices Q1 and Q2, respectively, coupled in series between upper and lower DC bus rails 112*a* and 112*b*, and a capacitance C2 is provided between the upper DC bus rail 112*a* and a circuit ground at the lower DC rail 112*b*. Any type or form and number of switching devices Q1 and Q2 may be used, where the exemplary switches Q1 and Q2 are NPN and PNP bipolar transistors, respectively. The switches Q1 and Q2 are alternatively switched to create a generally square-wave signal at an inverter output node 124 to excite a resonant circuit formed by the output transformer winding T1*a* and capacitances C6 and C8 to thereby drive a high frequency bus at the connection of diode D1 and T1*a*. The switches Q1 and Q2 are alternately activated to provide a square wave having an amplitude of ½ the DC bus level at the common inverter output node 211 (e.g., half the DC bus voltage across the terminals 112*a* and 112*b*), and this square wave inverter output excites the resonant circuit.

The inverter 120 includes a transformer T1 with windings for output power sensing and control for self-oscillation with adjustable inverter operating frequency 162, including a first winding T1*a* in series between the inverter output 124 and the high frequency bus, along with winding T1*b* in a switch drive control circuit including a frequency control circuit 122 formed by a capacitance C3 and an inductor L2 in series between the inverter output 124 and the base terminals of Q1 and Q2. Capacitor C4 is also connected between the switch base terminals and the inverter output 124, a resistance R2 is coupled between the positive bus terminal 112*a* and the inverter output 124, and a capacitance C7 is coupled between the inverter output 124 and the negative bus terminal 112*b*. In addition, resistance R1 is coupled between the base terminals and the lower DC bus terminal 112*b* to bias the base drives. In operation, the transformer winding T1*a* acts as a primary in the resonant circuit and the secondary winding T1*b* provides oscillatory actuation of the switches Q1 and Q2 according to the resonance of the resonant circuit, thereby providing a self-oscillating inverter 120 to drive the lamp 108. AC power from the high frequency bus provides an AC output 106 used to drive one or more lamp loads 108, where any number of lamps 108 can be coupled with the high frequency bus for different lighting applications.

The inverter 120 creates the square wave signal at the output 124 at an inverter frequency set by the impedances of the frequency control circuit 122. In the preheating period $T_{PH}$ (FIG. 2 above), the frequency is determined by the series LC combination of C3 and L2. This frequency, being higher than the T1*a*, C6 frequency, keeps the lamp voltage below the voltage required for ignition. This preheat frequency also reduces the voltage applied to the lamp 108, thereby reducing the glow current prior to ignition, resulting in improved lamp life, particularly when the ballast 100 is subjected to rapid cycles.

The preheating circuit 250 in the example of FIG. 3 includes an auxiliary capacitance C12 connected in a series circuit with a MOSFET switching device Q3 across the inverter capacitance C3, such that when the switch Q3 is conducting (ON), the capacitance of the frequency control circuit 122 is controlled by the sum of the capacitances C3+C12 (e.g., 69 nF in the illustrated embodiment). Q3 is initially OFF, and thus in the preheating period $T_{PH}$ following initial powerup of the ballast 100, the capacitance of the frequency control circuit 122 is C3 (e.g., 22 nF) and the inverter 120 is maintained in a first frequency range (e.g., about 100 KHz as shown in FIG. 2 in one example) to preheat the lamp cathodes using power from the inverter output 124. The preheating circuit 250 includes a timer circuit 252 with resistors R3 and R4 and a timing capacitor C11, which actuate the switch Q3 to connect the auxiliary capacitance C12 in parallel with C3 of the frequency control circuit 122 a predetermined time $T_{PH}$ following application of power to the DC power circuit 110. Once power is applied to the ballast 100, the timing capacitor C11 charges through resistor R4 and a diode D7 to the point where the gate voltage of Q3 exceeds the threshold Vt ($t_1$ in FIG. 2). Q3 thus turns on, connecting C12 in parallel with C3 of the inverter 120 to set the frequency 162 of the inverter output 124 to be in a second range (e.g., about 60 KHz in the illustrated example), after which the lamp 108 ignites an normal operation begins. The values of the components C11 and R4 may be selected to provide any desired preheating period $T_{PH}$ for adequately preheating the lamp cathodes before lamp ignition.

Figure 4:
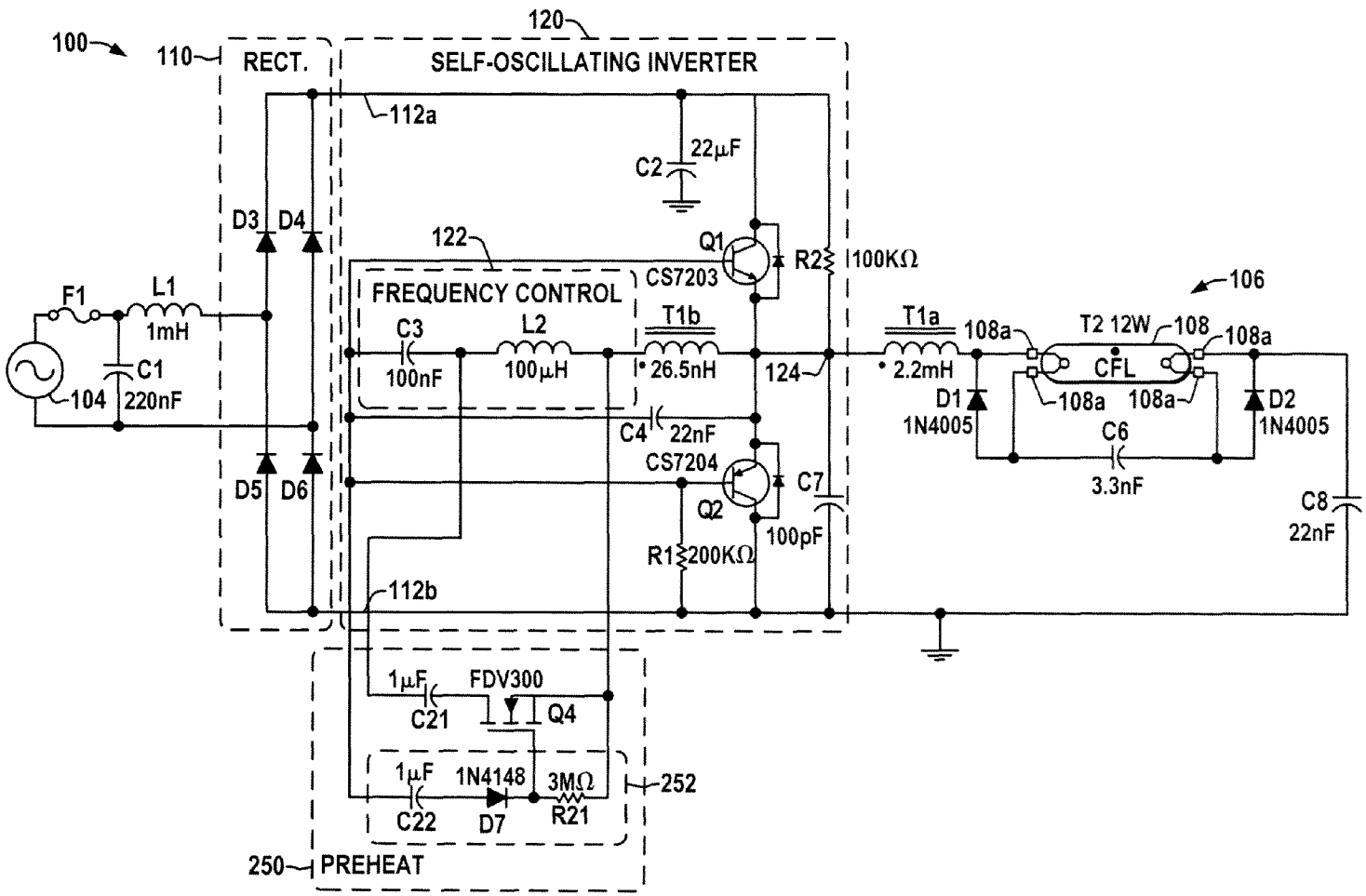
FIG. 4 is a schematic diagram illustrating another fluorescent lamp ballast embodiment in which the preheat circuit modifies an inductance of the inverter lamp cathode preheating.

FIG. 4 illustrates another exemplary ballast 100 having similar operation to the embodiment of FIG. 3. In the example of FIG. 4, however, the preheating circuit 250 controls the inverter frequency 162 by initially limiting the voltage to the inductor L2 in the frequency control circuit 122, thereby increasing the frequency of the inverter 120 and preheating the lamp cathode filaments via the resonant capacitor C6. As with the above embodiment of FIG. 3, increasing the inverter frequency reduces the voltage applied to the lamp, thereby reducing the glow current prior to ignition, while preheating the cathodes using inverter output current without the use of a PTC device. In this embodiment, the inductance L2 is selectively modified by the preheating circuit 250 to control the frequency 162 of the inverter output 124. The preheating circuit 250 in FIG. 4 includes a switching device Q4 coupled in series with a capacitor C21 across the inductance L2, along with a timer circuit 252 operative to actuate the switching device Q4 to shunt the inductance L2 a predetermined time $T_{PH}$ after power is applied to the ballast 100. The timing circuit 252 in this example includes a timing capacitor C22 coupled in series with a charging diode D7 and a resistor R21. Q4 is initially conductive (ON) and capacitors C21 and C22 are discharged. As the inverter 120 begins to oscillate, C22 is charged via D7 and R21, while the gate voltage of Q4 remains above its threshold voltage Vt, whereby Q4 shunts the inductor L2 with capacitor C21. This shunting maintains the voltage across L2 low enough to drive the inverter frequency high (e.g., 100 KHz in this example). Once the voltage across C22 is sufficient to reduce the C3 gate voltage below Vt (e.g., at $t_1$ in FIG. 2), Q4 turns OFF (non-conductive), causing the inverter frequency to fall to the second range (e.g., 60 KHz). This increases the lamp voltage to initiate lamp ignition and normal operation ensues.

Figure 5:
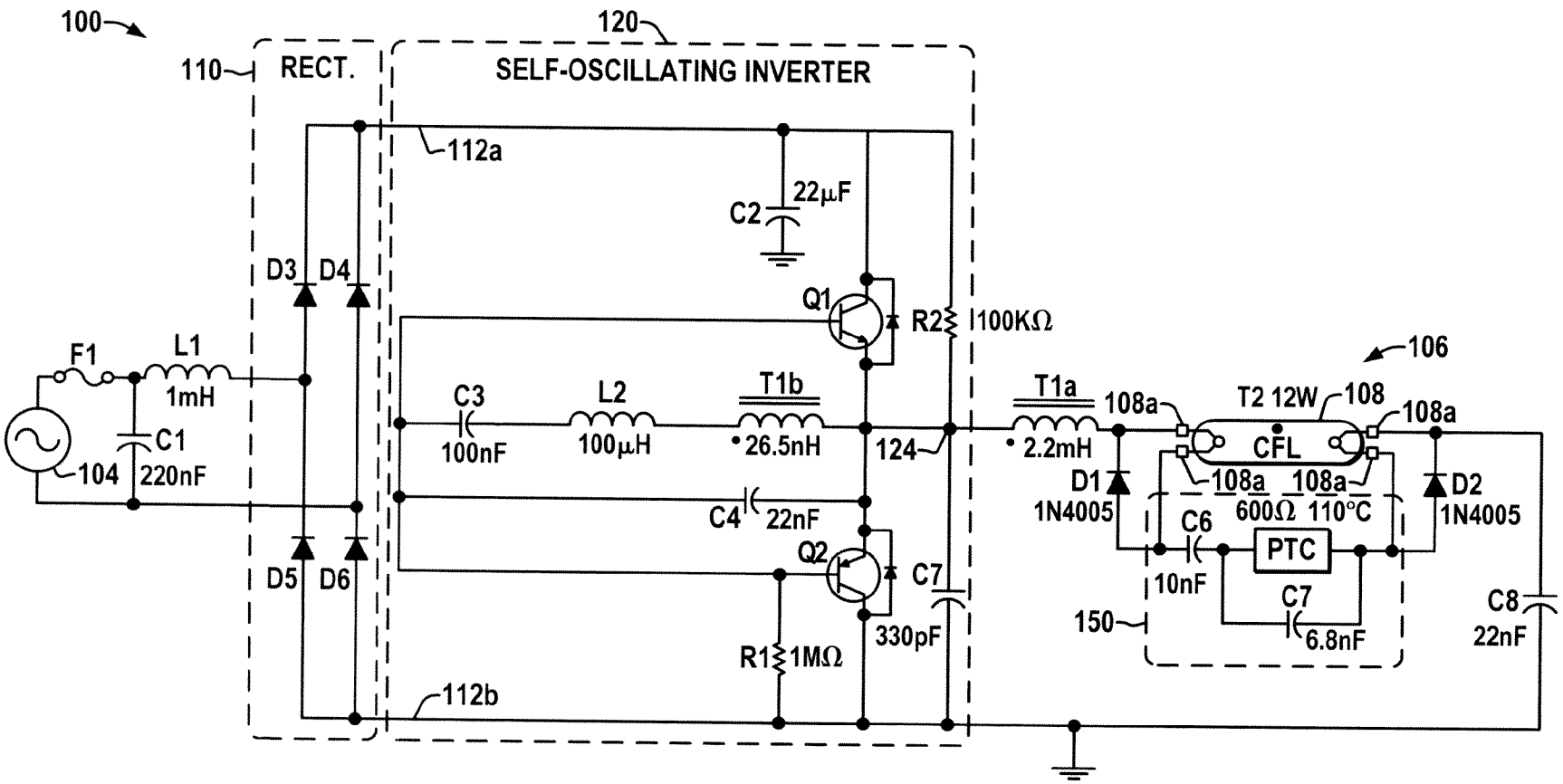
FIG. 5 is a schematic diagram illustrating another embodiment of a fluorescent lamp ballast with diodes coupled across lamp terminals to block current flow from the inverter output and to terminate inverter oscillation when the lamp is removed.

Referring now to FIG. 5, A ballast 100 is shown for operating one or more fluorescent lamps 108, including a rectifier 110 operative to receive an AC input 104 and to produce a DC output 112, and a self-oscillating inverter 120 that converts the DC output to produce an inverter output 124 to power one or more fluorescent lamps 108, generally as described above in connection with FIGS. 3 and 4. The embodiment of FIG. 5 includes a conventional PTC device coupled with the resonant capacitance C6 and an additional capacitor C7 for preheating the lamp cathodes. In addition, the ballast 100 provides first and second diodes D1, D2 individually coupled across the lamp terminals 108*a* associated with first and second cathodes of the lamp 108 to block current flow from the inverter output 124 and terminate oscillation of the inverter 120 when the lamp 108 is disconnected from the terminals 108*a*. Prior to lamp ignition, with a cool PTC device, preheating current flows through one lamp cathode, the capacitor C6, the PTC device and then through the other cathode. The cool PTC is initially low impedance (e.g., 600 OHMs in one example) and thus conducts preheating current through the lamp cathodes. As this preheating current continues to flow, the PTC heats up and its resistance increases, eventually triggering ignition of the gas in the lamp 108. Once the lamp 108 is ignited, arc current flows in the lamp with the diodes D1 and D2 rectifying the voltage across the cathodes. Moreover, if the lamp 108 is removed during ballast operation, the diodes D1 and D2 block current flow from the inverter output 124 and terminate the inverter oscillation to avoid potential oscillation run-away conditions.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A ballast for operating one or more fluorescent lamps, the ballast comprising: a DC power circuit operative to receive an AC input and to produce a DC output; an inverter operatively coupled to the DC power circuit to convert the DC output to produce an inverter output to power at least one fluorescent lamp, the inverter including a frequency control circuit operative to control a frequency of the inverter output; and a preheating circuit operatively coupled with the inverter to modify at least one impedance in the frequency control circuit to control the frequency of the inverter output to be in a first range during a preheating period following application of power to the DC power circuit to preheat at least one cathode of the lamp using power from the inverter output and to control the frequency of the inverter output to be in a different second range following ignition of the lamp; where the frequency control circuit of the inverter includes a frequency control capacitor with a first terminal connected to control terminals of a first and a second inverter switching device, and a second terminal, and where the preheating circuit is operative to modify a capacitance value of the frequency control circuit to control the frequency of the inverter output.

2. The ballast of claim 1, further comprising first and second diodes individually coupled across lamp terminals associated with first and second cathodes of the lamp to block current flow from the inverter output and terminate oscillation of the inverter when the lamp is disconnected from the terminals.

3. The ballast of claim 1, where the preheating circuit comprises:

an auxiliary capacitance;

a switching device operatively coupled between the auxiliary capacitance and the frequency control capacitor of the frequency control circuit; and a timer circuit operative to actuate the switching device to connect the auxiliary capacitance in parallel with the frequency control capacitor of the frequency control circuit a predetermined time following application of power to the DC power circuit.

4. The ballast of claim 3, further comprising first and second diodes individually coupled across lamp terminals associated with first and second cathodes of the lamp to block current flow from the inverter output and terminate oscillation of the inverter when the lamp is disconnected from the terminals.

5. The ballast of claim 3, comprising a transformer with a first transformer winding coupled between the inverter output and a high frequency bus, and a second transformer winding with a first terminal connected to the inverter output;

wherein the frequency control circuit of the inverter comprises a frequency control inductor with a first terminal connected to the second terminal of the frequency control capacitor, and a second terminal connected to a second terminal of the second transformer winding;

wherein the switching device of the preheating circuit comprises a first terminal connected to the first terminal of the frequency control capacitor, and a second terminal connected to a first terminal of the auxiliary capacitance; and wherein the auxiliary capacitance comprises a second terminal connected to the second terminal of the frequency control capacitor and the first terminal of the frequency control inductor.

6. The ballast of claim 1, comprising a transformer with a first transformer winding coupled between the inverter output and a high frequency bus, and a second transformer winding with a first terminal connected to the inverter output;

wherein the frequency control circuit of the inverter comprises a frequency control inductor with a first terminal connected to the second terminal of the frequency control capacitor, and a second terminal connected to a second terminal of the second transformer winding.

7. The ballast of claim 1, wherein the first inverter switching device is an NPN transistor connected between a first terminal of the DC output and the inverter output, wherein the control terminal of the first inverter switching device is a gate terminal of the NPN transistor, wherein them second inverter switching device is a PNP transistor connected between a second terminal of the DC output and the inverter output, wherein the control terminal of the second inverter switching device is a gate terminal of the PNP transistor, wherein the first terminal of the frequency control capacitor is connected directly to the gate terminal of the NPN transistor, and wherein the first terminal of the frequency control capacitor is connected directly to the gate terminal of the PNP transistor.

8. A ballast for operating one or more fluorescent lamps, the ballast comprising:

a DC power circuit operative to receive an AC input and to produce a DC output;

an inverter operatively coupled to the DC power circuit to convert the DC output to produce an inverter output to power at least one fluorescent lamp, the inverter including a frequency control circuit operative to control a frequency of the inverter output;

a transformer with a first transformer winding coupled between the inverter output and a high frequency bus, and a second transformer winding with a first terminal connected to the inverter output; and a preheating circuit operatively coupled with the inverter to modify at least one impedance in the frequency control circuit to control the frequency of the inverter output to be in a first range during a preheating period following application of power to the DC power circuit to preheat at least one cathode of the lamp using power from the inverter output and to control the frequency of the inverter output to be in a different second range following ignition of the lamp;

where the frequency control circuit of the inverter includes:

a frequency control capacitor with a first terminal connected to control terminals of first and second inverter switching devices, and a second terminal, and a frequency control inductor with a first terminal connected to the second terminal of the frequency control capacitor, and a second terminal connected to a second terminal of the second transformer winding; and where the preheating circuit is operative to modify an inductance value of the frequency control circuit to control the frequency of the inverter output.

9. The ballast of claim 8, where the preheating circuit comprises:

a switching device operatively coupled across the frequency control inductor of the frequency control circuit; and a timer circuit operative to actuate the switching device to shunt the frequency control inductor a predetermined time following application of power to the DC power circuit.

10. The ballast of claim 9, further comprising first and second diodes individually coupled across lamp terminals associated with first and second cathodes of the lamp to block current flow from the inverter output and terminate oscillation of the inverter when the lamp is disconnected from the terminals.

11. The ballast of claim 9, wherein the preheating circuit comprises an auxiliary capacitance with a first terminal connected to the first terminal of the frequency control inductor, and a second terminal; and wherein the switching device of the preheating circuit comprises a first terminal connected to the second terminal of the auxiliary capacitance, and a second terminal connected to the second terminal of the frequency control inductor.

12. The ballast of claim 8, further comprising first and second diodes individually coupled across lamp terminals associated with first and second cathodes of the lamp to block current flow from the inverter output and terminate oscillation of the inverter when the lamp is disconnected from the terminals.

13. The ballast of claim 8, wherein the first inverter switching device is an NPN transistor connected between a first terminal of the DC output and the inverter output, wherein the control terminal of the first inverter switching device is a gate terminal of the NPN transistor, wherein the second inverter switching device is a PNP transistor connected between a second terminal of the DC output and the inverter output, wherein the control terminal of the second inverter switching device is a gate terminal of the PNP transistor, wherein the first terminal of the frequency control capacitor is connected directly to the gate terminal of the NPN transistor, and wherein the first terminal of the frequency control capacitor is connected directly to the gate terminal of the PNP transistor.

14. A ballast for operating one or more fluorescent lamps, the ballast comprising:

a DC power circuit operative to receive an AC input and to produce a DC output;

an inverter operatively coupled to the DC power circuit to convert the DC output to produce an inverter output to power at least one fluorescent lamp, the inverter comprising a first inverter transistor with a first gate control terminal, and a second inverter transistor with a second gate terminal;

a transformer with a first transformer winding coupled between the inverter output and a high frequency bus, and a second transformer winding with a first terminal connected to the inverter output;

a frequency control circuit, comprising:

a frequency control capacitor having a first control capacitor terminal connected to provide gate control signals directly to the first and second gate control terminals of the first and second inverter transistors, and a second control capacitor terminal, and a frequency control inductor with a first control inductor terminal connected to the second control capacitor terminal, and a second control inductor terminal connected to a second terminal of the second transformer winding; and a preheating circuit operative to modify a capacitance value or an inductance value of the frequency control circuit to preheat at least one cathode of the lamp during a preheating period following application of power to the DC power circuit.

15. The ballast of claim 14, wherein the first transistor is an NPN transistor and wherein the second inverter transistor is a PNP transistor.

16. The ballast of claim 14, comprising:

first and second diodes individually coupled across lamp terminals associated with first and second cathodes of the lamp to block current flow from the inverter output and terminate oscillation of the inverter when the lamp is disconnected from the terminals;

a positive temperature coefficient (PTC) device comprising a first terminal connected to an anode of the first diode;

a resonant capacitance comprising:

a first terminal connected to a second terminal of the PTC device, and a second terminal connected to an anode of the second diode; and a second capacitance connected in parallel with the PTC device and comprising:

a first terminal connected to the first terminal of the PTC device, and a second terminal connected to the second terminal of the PTC device.

17. A method of operating one or more fluorescent lamps, the method comprising:

converting an AC input to produce a DC output;

converting the DC output using an inverter with a pair of complementary transistors to produce an inverter output to power at least one fluorescent lamp;

using a preheat controller, modifying a value of at least one capacitance or inductance in a resonant base driver circuit connected to a control terminal of at least one of the complementary transistors of the inverter to control an operating frequency of the inverter to be in a first range during a preheating period following application of power to the inverter to preheat at least one cathode of the lamp using power from the inverter output and to control the frequency of the inverter output to be in a different second range following ignition of the lamp.

18. The method of claim 17, where modifying a value of at least one capacitance or inductance comprises selectively connecting an auxiliary capacitance in parallel with at least one capacitor connected to the control terminal a predetermined time following application of power to the inverter.

19. The method of claim 17, where modifying a value of at least one capacitance or inductance comprises selectively shunting at least one inductor connected to the control terminal a predetermined time following application of power to the inverter.

* * * * *